US008839561B2

(12) United States Patent
Yagi et al.

(10) Patent No.: US 8,839,561 B2
(45) Date of Patent: Sep. 23, 2014

(54) DOOR OPENING/CLOSING STRUCTURE

(75) Inventors: Ryuuichi Yagi, Osaka (JP); Takahisa Nagamine, Osaka (JP); Masahiko Horizumi, Shizuoka (JP)

(73) Assignee: Yagiken Co., Ltd., Osaka-shi (JP)

( * ) Notice: Subject to any disclaimer, the term of this patent is extended or adjusted under 35 U.S.C. 154(b) by 0 days.

(21) Appl. No.: 13/808,963

(22) PCT Filed: Jul. 28, 2011

(86) PCT No.: PCT/JP2011/067351

§ 371 (c)(1),
(2), (4) Date: Jan. 8, 2013

(87) PCT Pub. No.: WO2012/017924

PCT Pub. Date: Feb. 9, 2012

(65) Prior Publication Data

US 2013/0111818 A1 May 9, 2013

(30) Foreign Application Priority Data

Aug. 6, 2010 (JP) ..... 2010-177729
Dec. 6, 2010 (JP) ..... 2010-271939

(51) Int. Cl.
*E05D 15/00* (2006.01)

(52) U.S. Cl.
USPC ..... 49/381; 16/320; 16/321

(58) Field of Classification Search
USPC ..... 49/381, 463; 16/320, 385, 221
See application file for complete search history.

(56) References Cited

U.S. PATENT DOCUMENTS

| | | | | |
|---|---|---|---|---|
| 3,152,716 | A * | 10/1964 | Feldhahn | 220/230 |
| 5,210,906 | A * | 5/1993 | Aihara et al. | 16/232 |
| 2007/0157432 | A1* | 7/2007 | Weinstein | 16/320 |
| 2008/0129953 | A1* | 6/2008 | Blum et al. | 351/153 |
| 2009/0195747 | A1* | 8/2009 | Insua | 351/116 |
| 2012/0268891 | A1* | 10/2012 | Cencioni | 361/679.55 |
| 2013/0080762 | A1* | 3/2013 | Cretella et al. | 713/100 |
| 2013/0114039 | A1* | 5/2013 | Zelazowski | 351/153 |

FOREIGN PATENT DOCUMENTS

| | | | |
|---|---|---|---|
| DE | 3117505 | * | 11/1982 |
| DE | 202004007127 | * | 9/2004 |

(Continued)

OTHER PUBLICATIONS

International Preliminary Report mailed Mar. 21, 2013 in counterpart application No. PCT/JP2011/067351 (7 pages).

(Continued)

*Primary Examiner* — Jerry Redman
(74) *Attorney, Agent, or Firm* — Kratz, Quintos & Hanson, LLP

(57) ABSTRACT

Provided is a door opening/closing structure in which the attachment/detachment of the door is easy in the rotatably opening/closing door. In the door opening/closing structure, an axial member attached to a door and an axial member attached to an object to which the door is attached are arranged to oppose each other in at least one position of the rotatably fixed door, wherein one of the two axial members comprises a magnet and the other comprises a magnetic body or a magnet which attracts each other with the magnet.

12 Claims, 10 Drawing Sheets

(56) References Cited

FOREIGN PATENT DOCUMENTS

Figure 1:
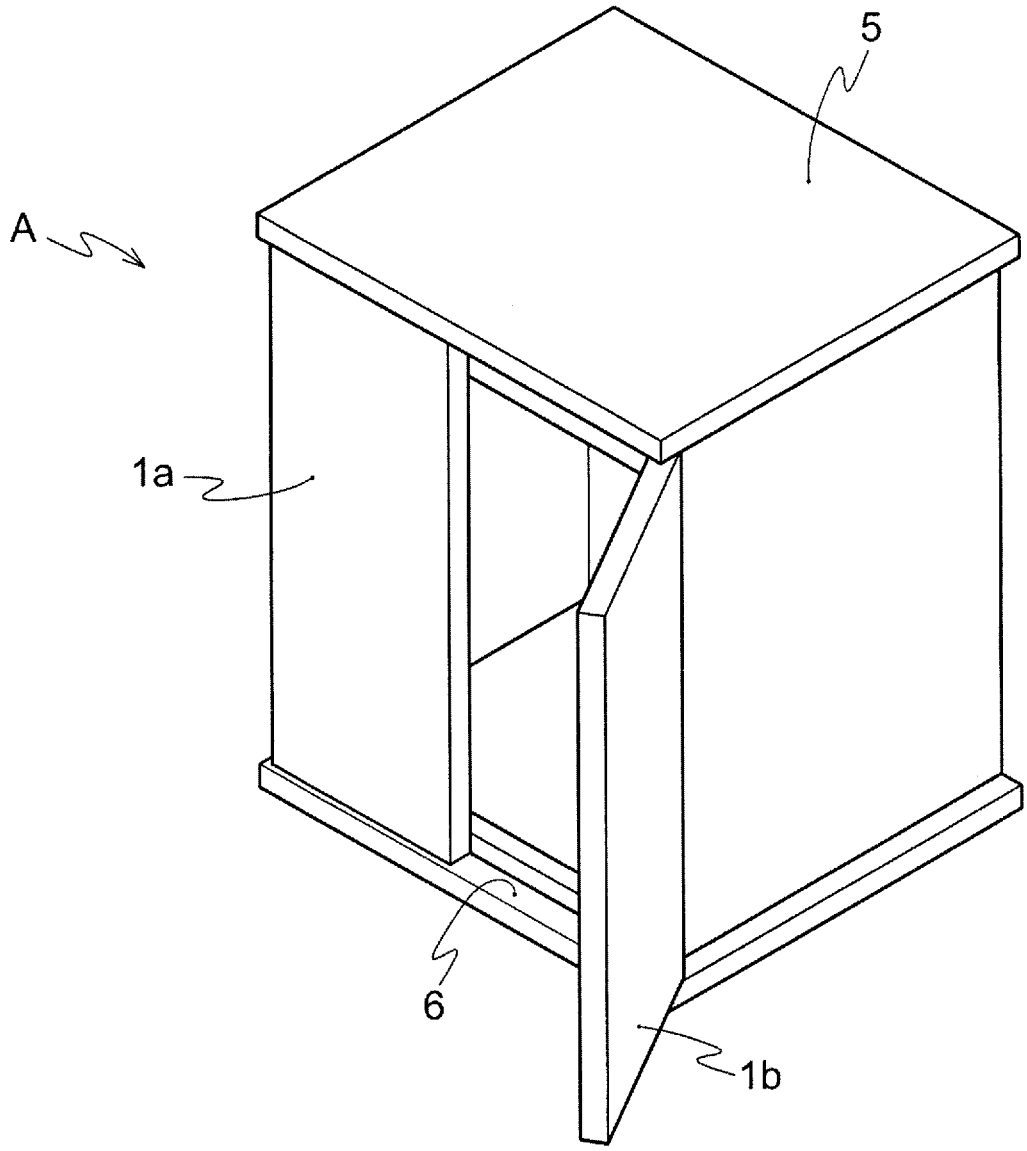

| | | | | |
|---|---|---|---|---|
| FR | 2955137 | | * | 12/2010 |
| JP | 04-215543 | | | 8/1992 |
| JP | H11-324466 | | | 11/1999 |
| JP | 2002-21411 | A1 | | 1/2002 |
| JP | 2005-105788 | | * | 4/2006 |
| JP | 2007-335929 | A1 | | 12/2007 |
| JP | 2009-287332 | A1 | | 12/2009 |
| JP | 3160035 | | | 5/2010 |
| JP | 3162614 | | * | 8/2010 |

OTHER PUBLICATIONS

Japanese Office Action mailed Oct. 22, 2013 in counterpart application No. 2010-271939 with partial English translation.

International Search Report for International Application No. PCT/JP2011/067351 dated Nov. 8, 2011.

* cited by examiner

DOOR OPENING/CLOSING STRUCTURE

TECHNICAL FIELD

The present invention relates to a door opening/closing structure and more specifically, the present invention relates to an opening/closing structure of a door which opens/closes rotatably and is attached to buildings, furniture, ornaments and the like.

BACKGROUND ART

Rotatably opening/closing doors have been widely used for buildings, furniture, ornaments and the like and many of the opening/closing structures of such doors have an opening/closing structure in which an axial member (convex portion) and a bearing (concave portion) are rotatably fixed in the concave-convex engagement. In Patent Document 1, the basic configuration of the door opening/closing structure also provides bearings in the center line of rotation at the door side and the main body side, which is an object to which the door is attached, and axial members rotatably engages in both bearings. However, these conventional door opening/closing structures are not intended for attachment/detachment of the door. Therefore, if the door is tried to be detached from the main body, it is not easy to attach and detach the door because of the interruption between the concavity and convexity of the axial members and the bearings.

Further, in Patent Document 2, the basic configuration is a concave-convex engagement fixation of a hinge axis (convex portion) and an engagement hole (concave portion), and there is proposed a hinge which is configured such that the hinge axis can be moved up and down and when the hinge axis comes close to the engagement hole, the hinge axis is protruded by the attraction of magnets provided in both of the hinge axis and the engagement hole, thereby the concave-convex engagement of the hinge axis and the engagement hole is achieved. However, this hinge is also included in a technique of fixing a door to an object to which the door is attached in the concave-convex engagement and if the door is tried to be detached from the main body, another means for releasing the concave-convex engagement fixation is required and thus the attachment/detachment of the door is not easy.

PRIOR ART DOCUMENT

Patent Document

Patent Document 1: Japanese Registered Utility Model No. 3160035

Patent Document 2: Japanese Unexamined Patent Publication 2002-021411

SUMMARY OF THE INVENTION

Problem to be Solved by the Invention

The present invention is made in the light of the above conventional problems and it is an object to provide a door opening/closing structure in which the attachment/detachment of the door is easy in the rotatably opening/closing door fixed to an object to which the door is attached by magnetic attraction.

Means to Solve the Problem

The door opening/closing structure of the present invention is characterized in that an axial member attached to the door and an axial member attached to an object to which the door is attached are arranged to oppose each other in at least one position of the rotatably fixed door. In the above two axial members, one comprises a magnet and the other comprises a magnetic body or a magnet which attracts each other with the magnet.

The door opening/closing structure of the present invention is characterized in that an axial member attached to the door and an axial member attached to an object to which the door is attached are arranged to oppose each other in at least one end of the door rotatably fixed in the both ends. In the above two axial members, one comprises a magnet and the other comprises a magnetic body or a magnet which attracts each other with the magnet.

Moreover, it is preferable that the door is rotatably fixed to the object to which the door is attached by magnetic attraction and configured to be detachable from the object to which the door is attached against the magnetic attraction, from the state where the door and the object to which the door is attached are fixed.

Further, it is preferable that the axial member attached to the door is fixed to the door, the axial member attached to the object to which the door is attached is fixed to the object to which the door is attached and these two axial members are arranged to oppose each other in their end faces.

Further, it is preferable that at least one of the above two axial members is attached to the door or the object to which the door is attached to move along the axial direction.

Further, it is preferable to provide the door or the object to which the door is attached with an elastic body which biases the movably attached axial member in the opposite direction of the magnetic attraction direction.

Further, it is preferable that a skid is provided in at least one of the opposing faces of the above two axial members.

Effect of the Invention

The present invention can fix a door to an object to which the door is attached not through a concave-convex engagement fixation but through magnetic attraction, preferably through magnetic attraction only. Therefore, in the state where the door and the object to which the door is attached are fixed by magnetic attraction, the door can be detached against the magnet attraction and thus the attachment/detachment of the door is easy. As a result, a purchaser himself can replace the door by other doors with different designs depending on the interior design or preference. In addition, since the door can be replaced by doors with other designs, there is no need to produce doors for each design and thus manufacturers can reduce the stock quantity. Therefore, the stock management becomes easy and the cost can be reduced. Moreover, since various designs can be taken in by only replacing doors, it is possible to drastically increase options of design. Furthermore, even if the door is broken, the replacement thereof is easy and thereby the cost burden on reparation can be reduced.

Moreover, in the door opening/closing structure in which the axial member is attached to the door or the object to which the door is attached to move along the axial direction, even if the case where a space is formed between the door and the object to which the door is attached and a space is formed between the opposing axial members, the movable axial member moves close to the opposing axial member by magnetic attraction depending on the space and preferably protrudes from the mounting surface thereof. Therefore, a rotatable fixation between the door and the object to which the door is attached through magnetic attraction can be ensured even for structures of different dimensional accuracies. For this reason, the rotatable fixation configuration via magnetic attraction can be easily applied to furniture having a certain degree of space between the door and the object to which the door is attached, without requiring high dimensional accuracy, for example. Here, this movable axial member is clearly different from conventional axial members since it is not the one moving along the axial direction for the engagement and release of the concave-convex engagement fixation, but is the one for carrying out the rotatable fixation by magnetic attraction. Furthermore, since the door can be detached from the object to which the door is attached against the magnetic attraction in the state where the door and the object to which the door is attached are fixed (in the state where the axial member is extracted by magnetic attraction and protrudes from the mounting surface thereof), the action of this axial member is substantially different from that of a conventional axial member which is configured movable on the premise of a concave-convex engagement fixation.

Further, in the door opening/closing structure in which an elastic body biasing a movable axial member in the opposite direction of the magnetic attraction direction is attached to the movable axial member, in the state where the door and the object to which the door is attached are not fixed, the movable axial member is biased to the side of the mounting surface thereof by the elastic body and preferably biased to the direction where the axial member does not protrude from the mounting surface thereof. Therefore, the axial member does not interrupt the attachment of the door. On the other hand, when the door is attached to the object to which the door is attached, the axial member moves towards the opposing axial member by magnetic attraction against the biasing force of the elastic body and preferably protrudes from the mounting surface thereof. Therefore, it becomes possible to easily and securely perform the rotatable fixation between the door and the object to which the door is attached through magnetic attraction.

Furthermore, by providing a skid on the facing surfaces of the axial member of the door and the axial member of the object to which the door is attached, friction resistance between the axial member of the door and the axial member of the object to which the door is attached is reduced and the door can be easily rotated and attached/detached.

BRIEF DESCRIPTION OF THE DRAWINGS (FIG. 1) A schematic perspective view of furniture according to a first embodiment of the present invention.

(FIG. 2) A schematic sectional view of a door opening/closing structure provided in the furniture of FIG. 1.

(FIG. 3) A schematic perspective view of furniture according to a second embodiment of the present invention.

Figure 3:
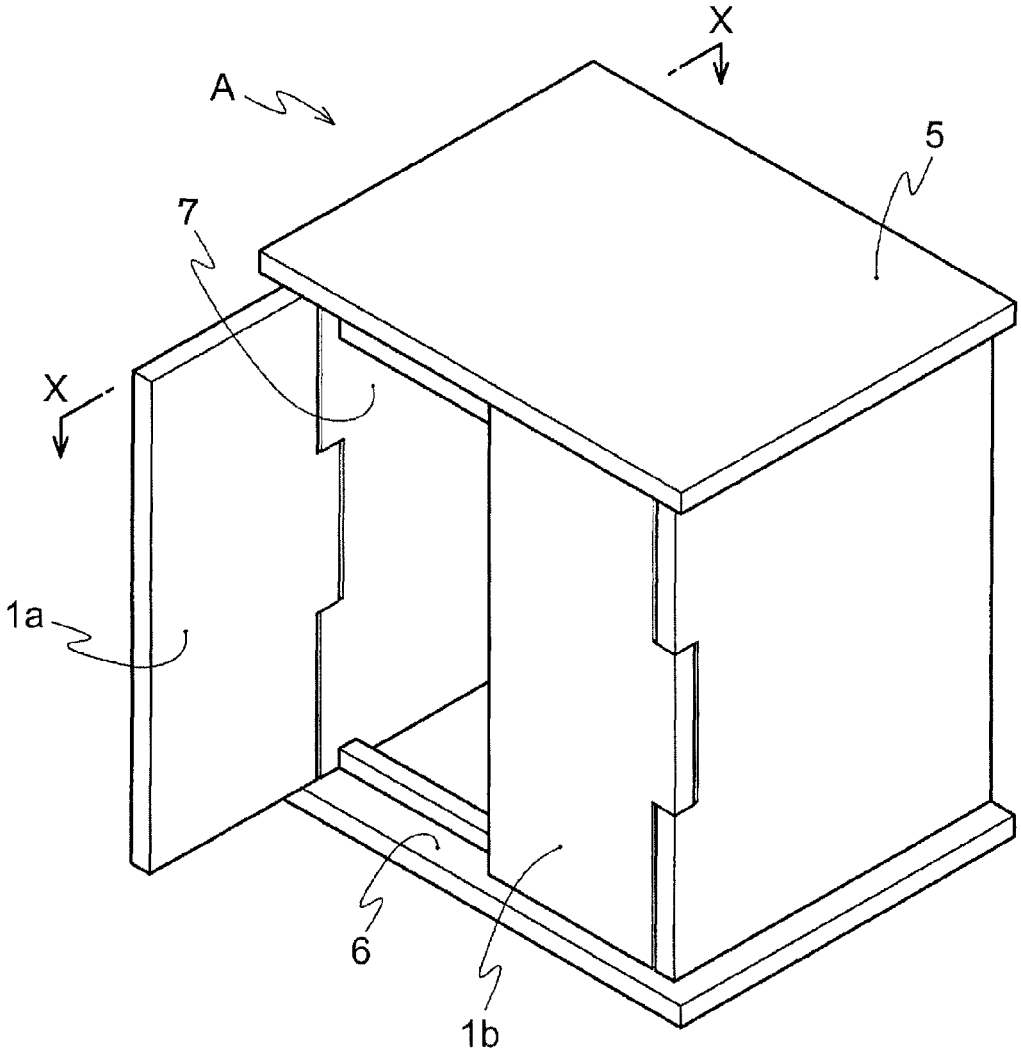

(FIG. 4) A schematic sectional view of a door opening/closing structure provided in the furniture of FIG. 3 in the line X-X.

Figure 4:
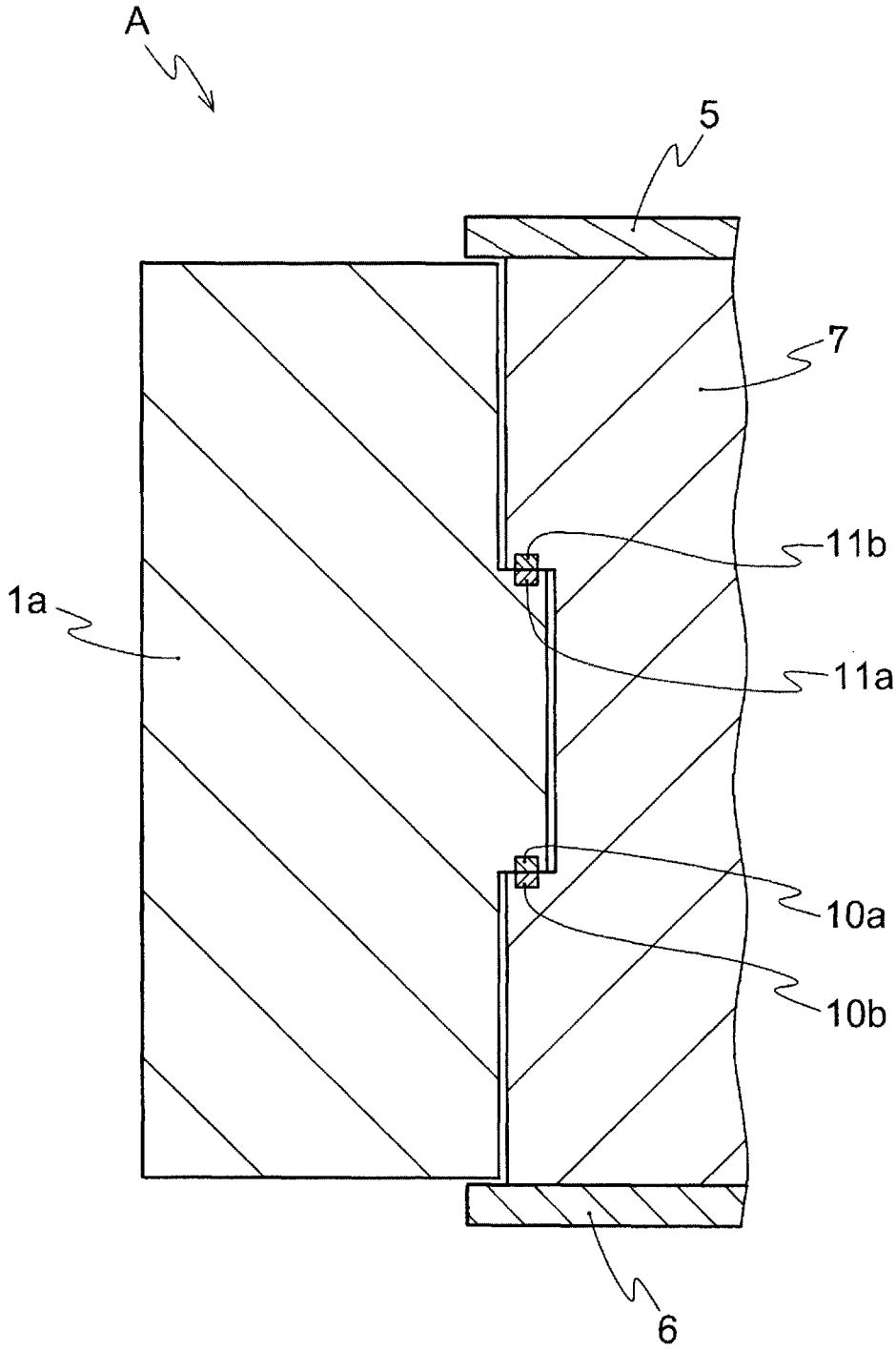

(FIG. 5) A schematic sectional view of the door opening/closing structure provided in the furniture according to the third embodiment of the present invention and corresponding to FIG. 4.

(FIG. 6) A schematic perspective view of furniture relating to a door opening/closing structure according to a forth embodiment of the present invention.

Figure 6:
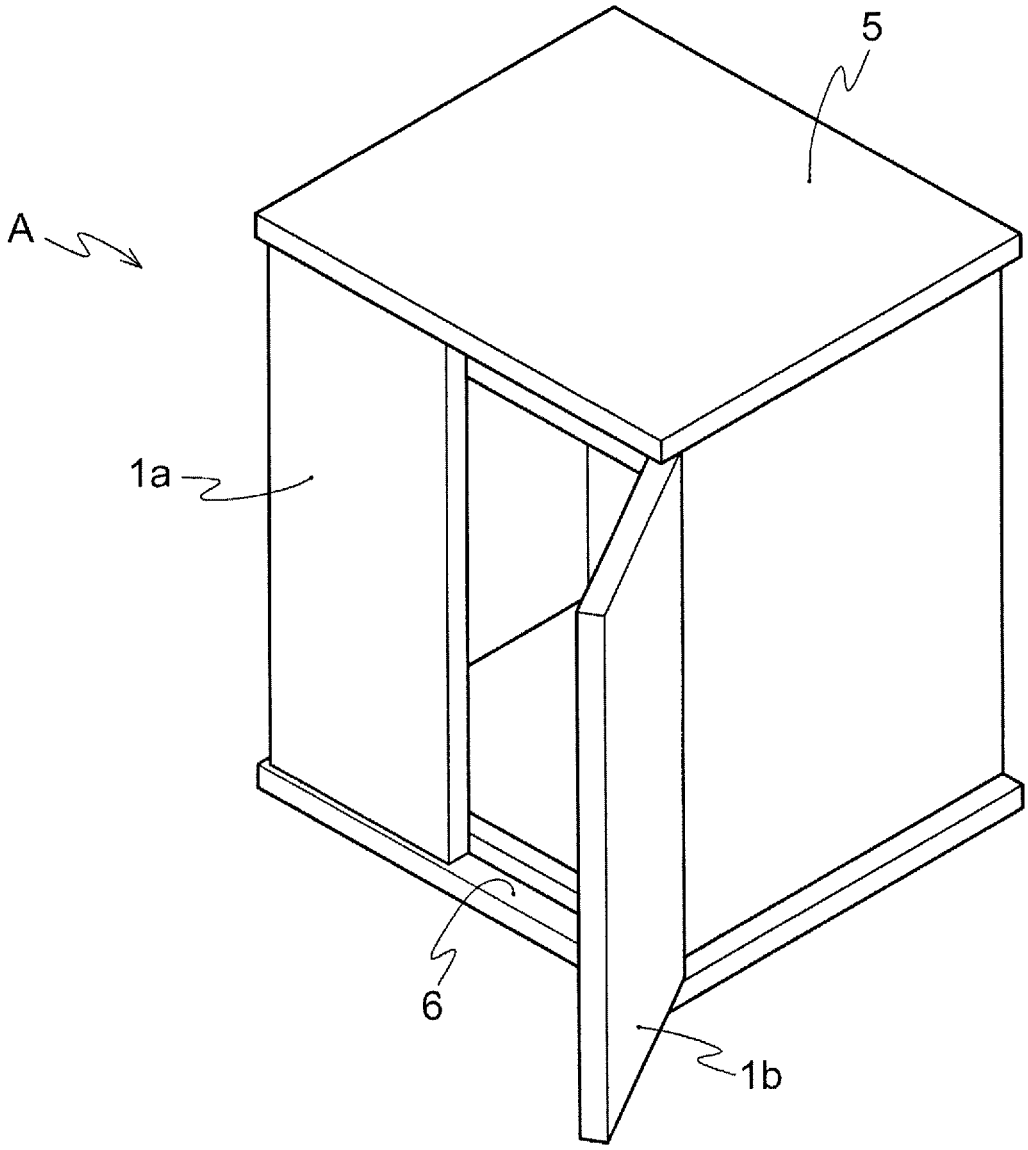

(FIG. 7) A schematic sectional view of the door opening/closing structure provided in the furniture of FIG. 6.

Figure 7:
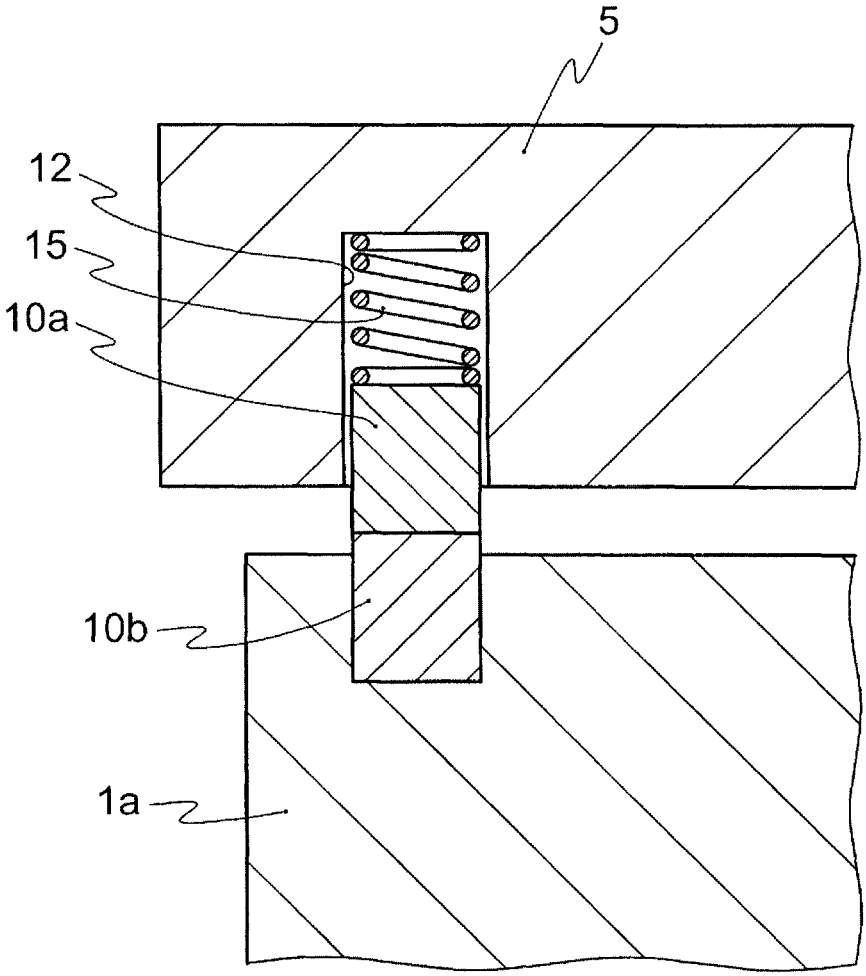

(FIG. 8) A schematic sectional view of an object to which a door is attached before the door is attached and corresponding to FIG. 7.

(FIG. 9) A schematic sectional view of a door opening/closing structure according to a fifth embodiment of the present invention.

Figure 9:
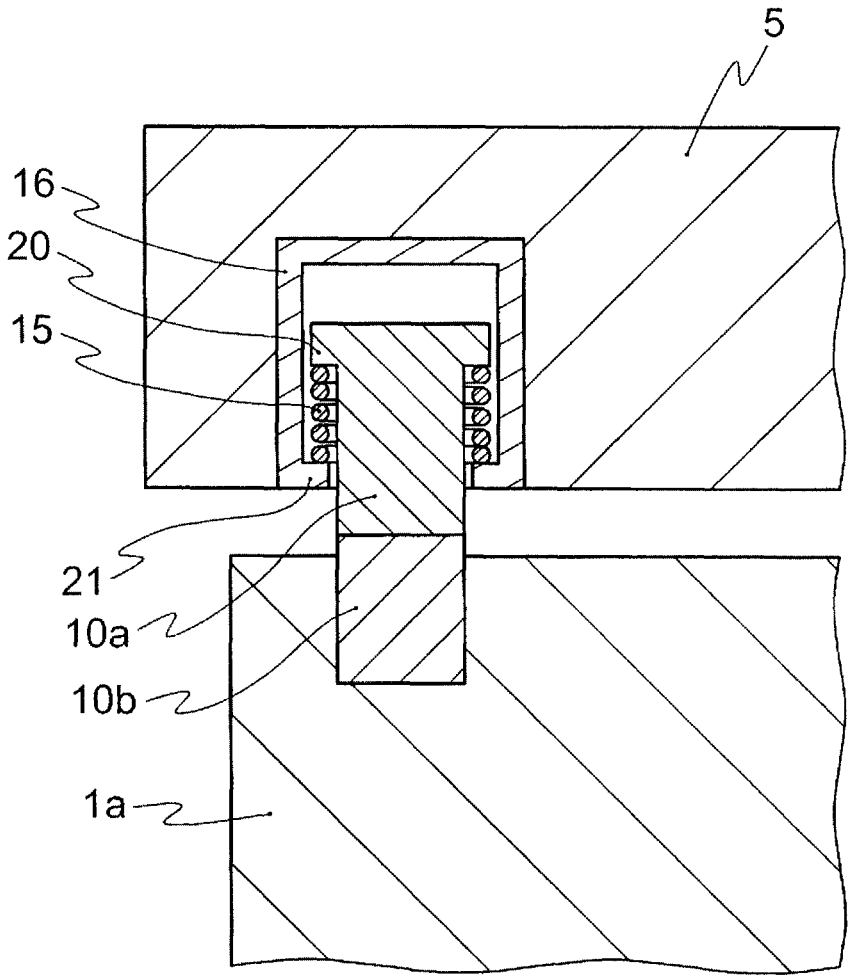

(FIG. 10) A schematic sectional view of an object to which the door is attached before the door is attached and corresponding to FIG. 9.

EMBODIMENT FOR CARRYING OUT THE INVENTION

The door opening/closing structure according to the embodiments of the present invention will be explained in detail referring to the drawings.

Figure 2:
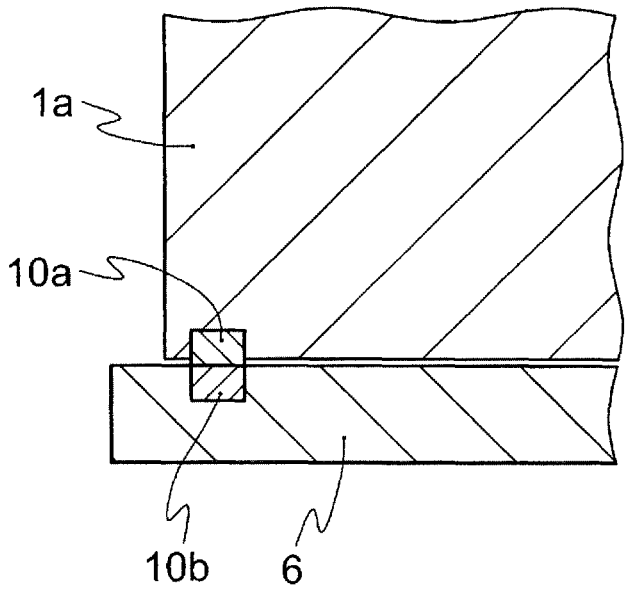

FIG. 1 is a schematic perspective view of furniture according to the first embodiment of the present invention and FIG. 2 is a schematic sectional view of a door opening/closing structure provided in the furniture of FIG. 1.

As shown in FIG. 1, the furniture A is a wooden structure in a box shape having a top plate 5 and a bottom plate 6, and three lateral sides are covered and almost all of the front surface is open. In the both sides of the front surface of the furniture A, a left-and-right pair of doors 1*a* and 1*b* which open and close in a gatefold manner are attached. The two doors 1*a* and 1*b* are a rectangular plate made of wood. The top and bottom of one side of the doors 1*a* and 1*b* are rotatably attached to the top plate 5 and the bottom plate 6 in a position anterior to the opening end of the front surface of the furniture A.

As shown in FIG. 2, in the bottom end of the door 1*a*, a cylindrical axial member (hereinafter, referred to as "first axial member") 10*a* is fixed by embedding so as to become approximately the same plane with the bottom surface of the door 1*a* and slightly protrude therefrom. On the other hand, in the top surface of the bottom plane 6 that is a member of the object to which the door is attached, a cylindrical axial member (hereinafter, referred to as "second axial member") 10*b* is fixed by embedding in a position opposing to the first axial member 10*a* so as to become approximately the same plane with the top surface of the bottom plate 6. Because of this, the first axial member 10*a* and the second axial member 10*b* are not exposed to exterior and thus do not influence the appearance. In addition, the above fixation is performed by fitting or with pins, screws or an adhesive.

The first axial member 10*a* comprises magnet and the second axial member 10*b* is iron. Because of this, the first axial member 10*a* and the second axial member 10*b* attract each other and the door 1*a* is rotatably fixed on the bottom plate 6. In this regard, though the types of magnets are not limited particularly, it is preferable to use permanent magnets such as a ferrite magnet or a neodymium magnet, which are easy to handle. The second axial member is not limited to iron and a magnetic body or a ferromagnetic body such as martensitic stainless steel can be also used.

The first axial member 10*a* and the second axial member 10*b* are arranged such that the bottom surface of the first axial member 10*a* and the top surface of the second axial member 10*b*, i.e. the end surfaces of the axial members 10*a* and 10*b* are opposed to each other. The both opposing surfaces are flat and a concave portion is not formed. The bottom surface of the top plate 5 and the top surface of the door 1*a* are also flat and thus a concavity and convexity for concave-convex engagement fixation of the door 1*a* is not formed. Additionally, both of the above opposing surfaces are a smooth surface. Because of this, friction resistance due to a contact between the first axial member 10*a* and the second axial member 10*b* is reduced, thereby the rotation of the door 1*a* and the attachment/detachment of the door 1*a* from the furniture A can be easily performed. Further, though a rotatable fixation at the top end of the door 1*a* is achieved with a publicly known bearing, the structure at the top end of the door 1*a* can be achieved with the above described structure used in the bottom end of the door 1*a*. Since the configuration of the door opening/closing structure in the door 1*b* is basically the same as the one used in the door 1*a*, the explanation thereof will be omitted.

FIG. 3 is a schematic perspective view of furniture according to the second embodiment of the present invention and FIG. 4 is a schematic sectional view of a door opening/closing structure provided in the furniture of FIG. 3 in the line X-X. Since the configuration of the door opening/closing structure according to this embodiment is basically the same as that according to the first embodiment which is explained above, the explanation will be focused on differences therebetween.

As shown in FIGS. 3 and 4, the door 1*a* according to the second embodiment is different from that according to the first embodiment in that the end surface at the opening surface side of the side wall 7 of the furniture A is concavely notched and a convex portion formed in the door 1*a* at the fixation end of the door 1*a* is inserted into the notch, and in that axial members 10*a* and 11*a* are fixed by embedding in the bottom end and the top end of the convex portion and axial members 10*b* and 11*b* are fixed by embedding in a position corresponding to the axial members 10*a* and 11*a* in the notch of the side wall 7. Moreover, spaces are provided between the door 1*a* and the vertical surfaces of the side wall 7 and between the convex portion and the notch such that the door 1*a* can rotate. This configuration also enables a door to be detached against magnetic attraction, since the door 1*a* is rotatably fixed to the side wall 7 to which the door is attached through magnetic attraction.

Figure 5:
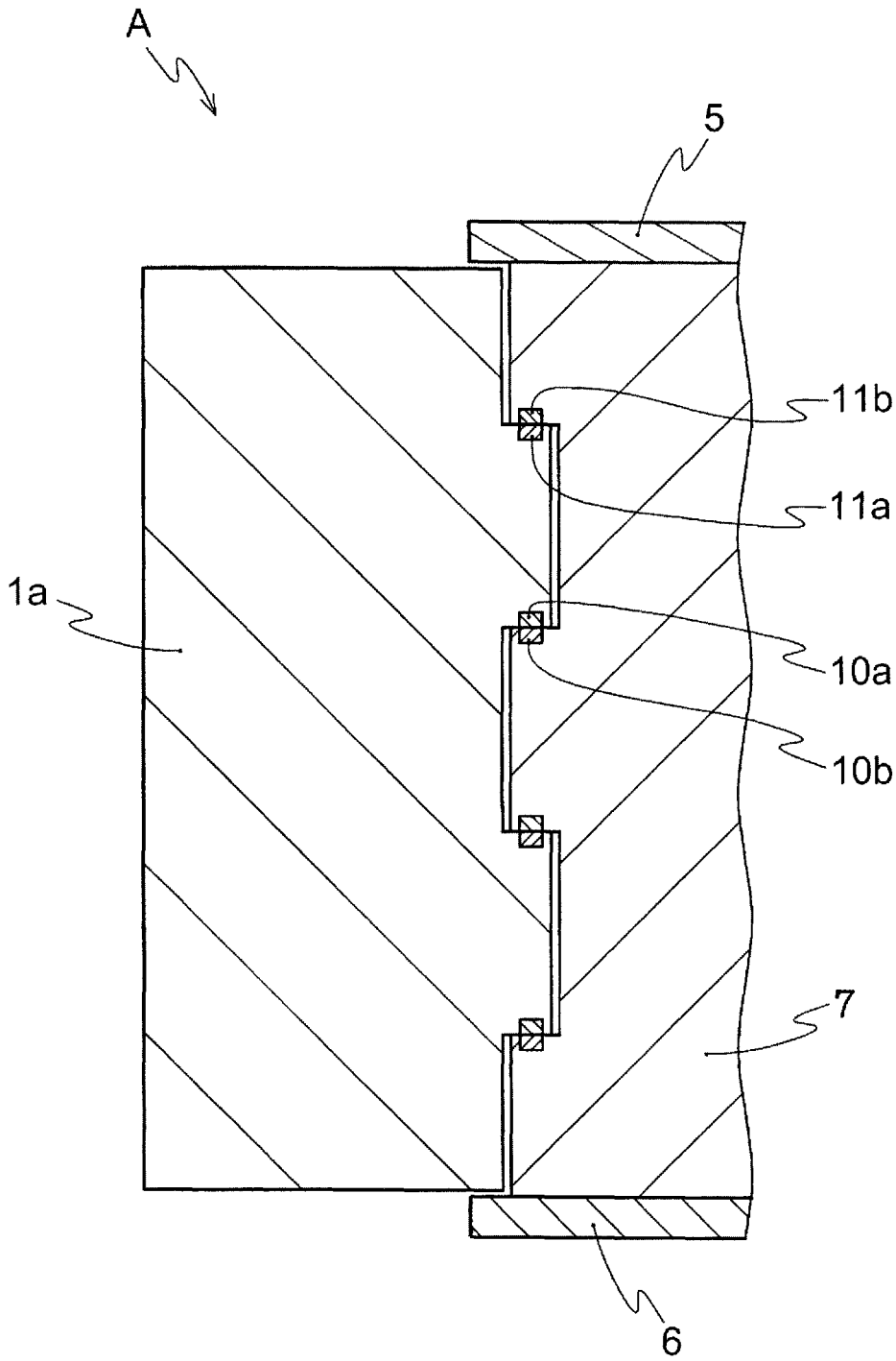

FIG. 5 is a schematic sectional view of the door opening/closing structure provided in the furniture according to the third embodiment of the present invention and corresponds to FIG. 4. Since the configuration of the door opening/closing structure according to this embodiment is basically the same as that according to the second embodiment which is explained above, the explanation will be focused on differences therebetween.

As shown in FIG. 5, the door 1*a* according to the third embodiment is different from that according to the second embodiment in that a plurality of (two) notches are formed at the upper side and lower side of the side wall at the opening surface side and a plurality of (two) convex portions are formed in the door 1*a* at the fixation end of the door 1*a* so as to correspond to the notches. This configuration also enables a door to be detached against magnetic attraction, since the door 1*a* is rotatably fixed to the side wall 7 to which the door is attached through magnetic attraction.

FIG. 6 is a schematic perspective view of furniture relating to a door opening/closing structure according to the forth embodiment of the present invention; FIG. 7 is a schematic sectional view of the door opening/closing structure provided in the furniture of FIG. 6; and FIG. 8 corresponds to FIG. 7 and is a schematic sectional view of an object to which a door is attached before the door is attached.

As shown in FIG. 6, furniture A provided with a door opening/closing structure according to the forth embodiment is a wooden structure in a box shape having a top plate 5 and a bottom plate 6, and three lateral sides are covered and almost all of the front surface is open. In the both sides of the front surface of the furniture A, a left-and-right pair of doors 1*a* and 1*b* which open and close in a gatefold manner are attached. The two doors 1*a* and 1*b* are a rectangular plate made of wood. The top and bottom of one side of the doors 1*a* and 1*b* are rotatably attached to the top plate 5 and the bottom plate 6 in a position anterior to the opening end of the front surface of the furniture A.

As shown in FIG. 7, in the bottom surface of a top plate 5 that is a member of the object to which the door 1*a* is attached, a cylindrical axial member (hereinafter, referred to as "first axial member") 10*a* is embedded in a concave portion 12 formed on the bottom surface of the top plate 5 and the bottom end of first axial member 10*a* protrudes downward from the bottom surface of the top plate 5. On the other hand, in the top edge of the door 1*a*, a cylindrical axial member (hereinafter, referred to as "second axial member") 10*b* is fixed by embedding in a position opposing to the first axial member 10*a* so as to become approximately the same plane with the top surface of the door 1*a* and slightly protrude therefrom.

The first axial member 10*a* is iron and the second axial member 10*b* comprises magnet. Thereby the first axial member 10*a* is attracted by the second axial member 10*b* and this magnetic attraction rotatably fixes the door 1*a* to the top plate 5. Here, the first axial member is not limited to iron and a magnetic body or a ferromagnetic body such as martensitic stainless steel can be also used. Though the types of magnets are not limited particularly either, it is preferable to use permanent magnets such as a ferrite magnet or a neodymium magnet, which are easy to handle.

Figure 8:
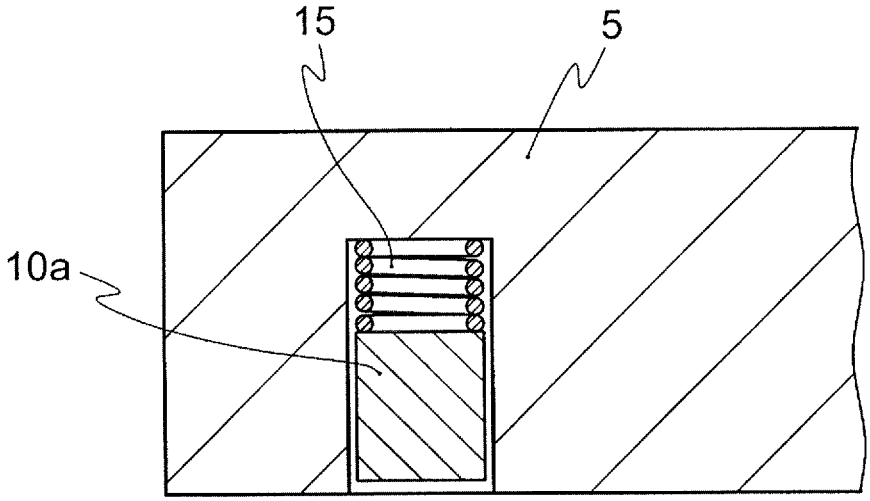

Moreover, the first axial member 10*a* is attached to the top plate 5 via a spring 15 as an elastic body. Because of this, the first axial member 10*a* becomes movable along the axial direction within the range of expansion and contraction of the spring 15 and slides in the concave portion 12. The spring 15 biases the first axial member 10*a* to the opposite direction of the magnetic attraction direction, that is, toward the direction of the top plate 5 which is the direction where the first axial member 10*a* does not protrude from the bottom surface of the top plate 5. Because of this, as shown in FIG. 8, the bottom end of the first axial member 10*a* does not protrude from the bottom surface of the top plate 5 and becomes approximately the same plane with the bottom surface of the top plate 5 before the door 1*a* is fixed, thereby does not become impeditive. On the other hand, when the door 1*a* is fixed to the furniture A, as shown in FIG. 7, the first axial member 10*a* moves toward the opposite second axial member 10*b* by magnetic attraction against the biasing force of the spring 15 and abuts on the second axial member 10*b*. As a result, even if a space is formed between the door 1*a* and the furniture A, the first axial member 10*a* moves for a distance only between the first axial member 10*a* and the second axial member 10*b* and thus the rotatable fixation can be ensured. The elastic body is not limited to a spring and a rubber or sponge can be also used. Additionally, the fixation of the second axial member is performed by fitting or with pins, screws or adhesive.

The bottom surface of the first axial member 10*a* and the top surface of the second axial member 10*b*, i.e. the opposing surfaces of the axial members are both flat and a concave portion is not formed. The bottom surface of the top plate 5 and the top surface of the door 1*a* are also flat and a concavity and convexity for concave-convex engagement fixation of the door 1*a* is not formed. Additionally, both of the above described opposing surfaces are a smooth surface and thereby friction resistance due to a contact between the axial members is reduced and the rotation of the door 1*a* and the attachment/detachment of the door 1*a* from the furniture A can be easily performed.

On the other hand, though a rotatable fixation at the bottom end of the door 1*a* is achieved with a publicly known bearing, the structure at the bottom end of the door 1*a* can be achieved with the above described structure used in the top end of the door 1*a*. Additionally, since the configuration of the door opening/closing structure in the door 1*b* is basically the same as the one used in the door 1*a*, the explanation thereof will be omitted.

Figure 10:
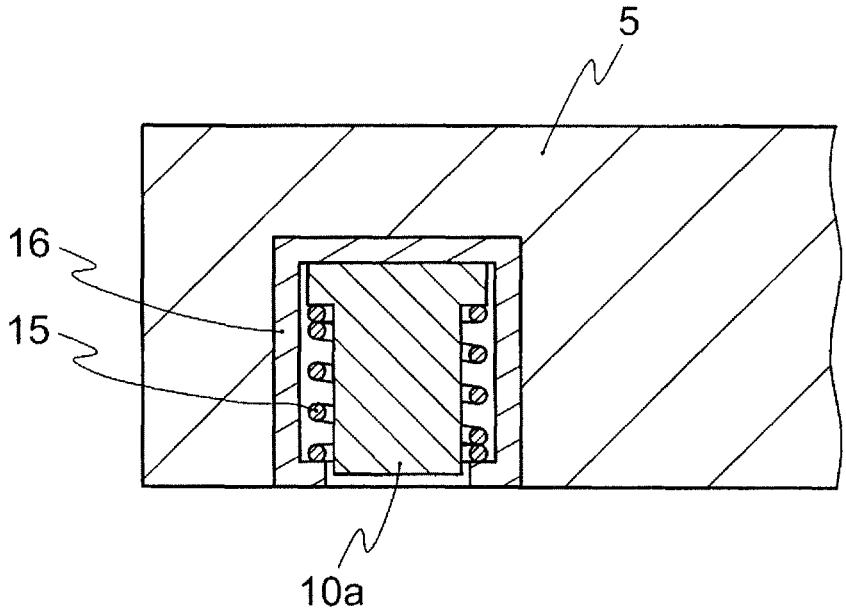

FIG. 9 is a schematic sectional view of a door opening/closing structure according to the fifth embodiment of the present invention; and FIG. 10 corresponds to FIG. 9 and is a schematic sectional view of the object to which the door is attached before the door is attached. Since the configuration of the door opening/closing structure according to this embodiment is basically the same as that according to the forth embodiment which is explained above, the explanation will be focused on differences therebetween.

As shown in FIGS. 9 and 10, the door 1*a* according to the fifth embodiment is different from that according to the forth embodiment in that a flange 20 is formed on the upper side of a first axial member 10*a* over the outer circumference and the first axial member 10*a* has a T-shaped longitudinal section, and that a casing 16 is fixed by embedding in a concave portion formed on the bottom surface of the top plate 5 and a compression spring 15 and the first axial member 10*a* are contained in the casing 16.

The casing 16 is a member with a cylindrical shape and contains the first axial member 10*a* and the spring 15 in a hollow portion thereof. On the bottom surface of the casing 16, a protrusion 21 extending toward the center of the casing 16 is formed over the circumference thereof, and an opening with a diameter which is larger than the outer circumference of the body of the axial member 10*a* and smaller than the outer circumference of the flange 20 of the axial member 10*a* is formed inside the protrusion 21. In the casing 16, as shown in FIG. 9, the spring 15 is rested on the protrusion 21 and the bottom end of the first axial member 10*a* is inserted into the opening on the bottom surface of the casing 16 via the spring 15 and the casing 16 is configured such that the spring 15 is sandwiched between the flange 20 of the first axial member 10*a* and the protrusion 21 of the casing 16. The casing 16 configured in this manner is fixed by embedding in the concave portion of the top plate 5 such that the opening side thereof is positioned on the bottom surface of the top plate 5. With this configuration, the first axial member 10*a* is also biased by the spring 15 to the opposite direction of the magnetic attraction direction, that is, the direction where the first axial member 10*a* does not protrude from the bottom surface of the top plate 5. Because of this, as shown in FIG. 10, the bottom end of the first axial member 10*a* does not protrude from the bottom surface of the top plate 5 and becomes approximately the same plane with the bottom surface of the top plate 5 before the door 1*a* is fixed, thereby the first axial member 10*a* does not become impeditive. On the other hand, when the door 1*a* is fixed to the furniture A, as shown in FIG. 9, the first axial member 10*a* moves toward the opposite second axial member 10*b* by magnetic attraction against the biasing force of the spring 15 and abuts on the second axial member 10*b*. As a result, even if a space is formed between the door 1*a* and the furniture A, the first axial member 10*a* moves for a distance only between the first axial member 10*a* and the second axial member 10*b* and thus the rotatable fixation can be ensured. Here, the material of the casing 16 is not limited and a non-magnetic metal, a synthetic resin and wood can be used.

As described above, according to the door opening/closing structure of the above embodiments of the present invention, the fixation between the door and the object to which the door is attached can be performed by magnetic attraction. Therefore, the door can be easily detached against the magnetic attraction from the state where the door and the object to which the door is attached are fixed by magnetic attraction, and thereby the attachment/detachment of the door is easy. Moreover, in the door opening/closing structures according to the forth and fifth embodiments, one axial member is configured to be movable along the axial direction. Therefore, even if a space is formed between the door and the object to which the door is attached, one axial member can move close to the opposing other axial member by magnetic attraction and abut thereon, depending on a distance of the space. As a result, the structure of the rotatable fixation due to magnetic attraction of the present invention can be also applied to millwork having a large dimensional tolerance such as furniture and a rotatable fixation between the door and the object to which the door is attached can be ensured even for structures of different dimensional accuracies. Further, by attaching an elastic body which biases the axial member to the opposite direction of the magnetic attraction direction, in the state where the door and the object to which the door is attached are not fixed, the axial member is biased to the direction where the axial member does not protrude from the mounting surface thereof, and thereby does not become impeditive. On the other hand, in the state where the door and the object to which the door is attached are fixed, the axial member moves to the opposing axial member and abuts thereon by magnetic attraction against the biasing force of the elastic body. As a result, the rotatable fixation between the door and the object to which the door is attached can be performed easily and certainly.

It should be noted that though the object to which the door is attached is furniture in the above embodiment, the present invention is not limited thereto and can be widely applied to boxes, buildings, or electronic devices. Also, opening/closing doors are not limited to a left-and-right pair of doors or a single door and can be also applied to a swing door opening/closing up and down and a lid-shaped swing door, and further applied to a door consisting of three or more doors. Moreover, the opening/closing includes a partial opening/closing and the state where a door is half-open. Doors are not limited to wooden doors as long as doors are made from a non-magnetic material, and doors may be made from a synthetic resin or aluminum.

Moreover, though the door opening/closing structure of the present invention is provided at one of the top side or bottom side of the door, the present invention is not limited thereto and door opening/closing structures of different embodiments may be appropriately combined and provided at each of both ends of the door. In addition, the rotational axis of the door is not limited to the longitudinal direction and in the case where the door opening/closing structure of the present invention is applied to a swing door opening/closing up and down or a lid-shaped swing door in which the rotational axis is horizontal, the door opening/closing structure can be provided at one or both of the both ends of the door. Additionally, the same applies to the case where the rotational axis of the door is inclined. It is also possible to apply the door opening/closing structure of the present invention to the rotational axis of a hinge which is attached to the door. The fixation of the axial member is not limited to a fixation by embedding in the door or object to which the door is attached and the axial member can be also attached externally.

Further, in the above embodiment, though the axial member is arranged so as to become approximately the same plane with the mounted surface thereof, the present invention is not limited thereto and the axial member may be arranged so as to protrude from the mounted surface thereof, or arranged so as not to protrude from the mounted surface but become the same plane with the mounted surface or dent from the mounted surface. Additionally, the axial member is not limited to the one embedded into a door or an object to which the door is attached, and the axial member can also be attached externally on the door or the object to which the door is attached.

Furthermore, though the shape of the axial member is cylindrical in the above embodiments, the shape of the axial member is not limited thereto and may be horn-shaped, spherical or flat, and as for a material of the axial member, a magnet can be used for the both axial members. In that case, the axial members are arranged such that the magnetic poles at the opposing ends of the two axial members are different. Further, the axial member is not limited to the one consisting of a magnet only or the one consisting of a magnetic body only, and a member comprising a magnet or magnetic body may be used. An example of such member is a casing containing a magnet or a molding consisting of a synthetic resin comprising a mixture of a magnet or magnetic body formed into particles.

Furthermore, though a smooth surface is formed on the axial member of the door and the axial member of the object to which the door is attached in the above embodiment, the smooth surface may be formed by polishing by use of an abrasive. Additionally, in order to reduce friction resistance due to a contact between the axial member of the door and the axial member of the object to which the door is attached, it is preferable that a skid is provided in at least one of the opposing faces of the axial member of the door and the axial member of the object to which the door is attached. Examples of a skid include a plating such as nickel-plating, a coating comprising a synthetic resin coating such as a Teflon (registered trademark) coating, a sheet member comprising a hard synthetic resin such as DURACON (registered trademark) or a rubber, a wooden plate, paper on which a synthetic resin is coated and lubricant oil. The thickness of these skids is not limited as long as it does not drastically deteriorate the force of attraction of the axial member of the door and the axial member of the object to which the door is attached. It is better that the thickness is as thinner as possible and preferably not more than 2 mm. The sheet member, wooden plate or coated paper can be fixed to the axial member with an adhesive. It goes without saying that the contact and abutment between the opposing surfaces of the axial members of the present invention include a contact and abutment via the above skid.

Furthermore, though the door is rotatably fixed to the side wall of furniture in the second and third embodiments, the present invention is not limited thereto and the door opening/closing structure of the present invention can be adopted when one door and another door are rotatably fixed. In that case, the object to be attached of one door is the other door.

Furthermore, though the movable axial member is attached to furniture that is an object to which the door is attached in the above forth and fifth embodiments, the present invention is not limited thereto and the movable axial member may be attached to the door or both of the door and the object to which the door is attached.

Explanation of Symbols

A Furniture
1, 1*a*, 1*b* Door
5 Top plate
6 Bottom plate
7 Side wall
10*a* (First) axial member
10*b* (Second) axial member
11*a*, 11*b* Axial member
12 Concave portion
15 Spring
16 Casing
20 Flange
21 Protrusion

The invention claimed is:

1. A door attachment structure configured such that a first axial member attached to a door and a second axial member attached to an object to which the door is attached are arranged to oppose each other in at least one position where the door is rotatably connected, wherein one of the first and second axial members comprises a first magnet and the other comprises a magnetic body or a second magnet which attracts the first magnet;

the first axial member is fixed to the door and the second axial member is fixed to the object to which the door is attached;

opposing surfaces of the first and second axial members are flat surfaces and the first and second axial members are arranged so as to become approximately planar with mounted surfaces thereof or arranged so as to protrude from the mounted surfaces thereof; and the door is arranged to be rotatably connected to the object to which the door is attached only by magnetic attraction.

2. The door attachment structure according to claim 1, wherein a skid is provided in at least one of the opposing surfaces of the first and second axial members.

3. A door attachment structure configured such that a first axial member attached to a door, having opposed ends, and a second axial member attached to an object to which the door is attached are arranged to oppose each other and at least one end door is rotatably connected at both opposed ends, wherein one of the first and second axial members comprises a first magnet and the other comprises a magnetic body or a second magnet which attracts the first magnet;

the first axial member is fixed to the door and the second axial member is fixed to the object to which the door is attached;

opposing surfaces of the first and second axial members are flat surfaces and the first and second axial members are arranged so as to become approximately planar with mounted surfaces thereof or arranged so as to protrude from the mounted surfaces thereof; and the door is arranged to be rotatably connected to the object to which the door is attached only by magnetic attraction.

4. The door attachment structure according to claim 3, wherein a skid is provided in at least one of the opposing surfaces of the first and second axial members.

5. A door attachment structure configured such that a first axial member attached to a door and a second axial member attached to an object to which the door is attached are arranged to oppose each other in at least one position where the door is rotatably connected to the object, wherein one of the first and second axial members comprises a first magnet and the other comprises a magnetic body or a second magnet which attracts the first magnet;

the door is rotatably connected to the object to which the door is connected by magnetic attraction and configured to be detachable from the object to which the door is attached against the magnetic attraction;

the first axial member connected to the door is fixed to the door, the second axial member connected to the object to which the door is attached is fixed to the object to which the door is connected and the first and second axial members are arranged to oppose each other at their end surfaces thereof; and at least one of the first and second axial members is movable, and an elastic body is provided which biases the movable axial member in a direction opposite the magnetic attraction direction.

6. The door attachment structure according to claim 5, wherein a skid is provided in at least one of the opposing surfaces of the first and second axial members.

7. A door attachment structure configured such that a first axial member attached to a door, having opposed ends, and a second axial member attached to an object to which the door is attached are arranged to oppose each other and at least one end of the door is rotatably connected at both opposed ends, wherein one of the first and second axial members comprises a first magnet and the other comprises a magnetic body or a second magnet which attracts the first magnet;

the door is rotatably connected to the object to which the door is attached by magnetic attraction and configured to be detachable from the object to which the door is attached against the magnetic attraction;

at least one of the first and second axial members is connected to the door or the object to which the door is attached so as to move along the axial direction, wherein at least one of the first and second axial members is movable, and wherein an elastic body is provided which biases the movable axial member in a direction opposite the magnetic attraction direction.

8. The door attachment structure according to claim 7, wherein a skid is provided in at least one of the opposing surfaces of the first and second axial members.

9. A door attachment structure configured such that a first axial member attached to a door and a second axial member attached to an object to which the door is attached are arranged to oppose each other in at least one position where the door is rotatably connected to the object, wherein one of the first and second axial members comprises a first magnet and the other comprises a magnetic body or a second magnet which attracts the first magnet;

at least one of the first and second axial members is connected to the door or the object to which the door is attached so as to move along the axial direction, wherein at least one of the first and second axial members is movable;

opposing surfaces of the first and second axial members are flat surfaces; and the door is rotatably connected to the object to which the door is attached by magnetic attraction wherein the first magnet is arranged to move between a stored state in which the first magnet does not extend beyond a mounting surface and a second state in which the first magnet moves and extends beyond the mounting surface, and the second magnet or magnetic body fixedly mounted at a second mounting surface, and wherein only the first magnet moves between the two states.

10. The door attachment structure according to claim 9, wherein a skid is provided in at least one of the opposing surfaces of the first and second axial members.

11. A door attachment structure configured such that a first axial member attached to a door, having opposed ends, and a second axial member attached to an object to which the door is attached are arranged to oppose each other and at least one end of the door is rotatably connected at both opposed ends, wherein one of the first and second axial members comprises a first magnet and the other comprises a magnetic body or a second magnet which attracts the first magnet;

at least one of the first and second axial members is connected to the door or the object to which the door is attached so as to move along the axial direction, wherein at least one of the first and second axial members is movable;

opposing surfaces of the first and second axial members are flat surfaces; and the door is rotatably connected to the object to which the door is attached by magnetic attraction wherein the first magnet is arranged to move between a stored state in which the first magnet does not extend beyond a mounting surface and a second state in which the first magnet moves and extends beyond the mounting surface, and the second magnet or magnetic body fixedly mounted at a second mounting surface, and wherein only the first magnet moves between the two states.

12. The door attachment structure according to claim 11, wherein a skid is provided in at least one of the opposing surfaces of the first and second axial members.

* * * * *